US007779936B2

(12) United States Patent
Felderhoff et al.

(10) Patent No.: US 7,779,936 B2
(45) Date of Patent: Aug. 24, 2010

(54) STAGGERED COMPACT ROW ON SAME LAND

(75) Inventors: Floyd C. Felderhoff, Montgomery, TX (US); Robert M. Welch, The Woodlands, TX (US); Yolanda V. Morse, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 21 days.

(21) Appl. No.: 12/237,602

(22) Filed: Sep. 25, 2008

(65) Prior Publication Data

US 2010/0071963 A1 Mar. 25, 2010

(51) Int. Cl.
*E21B 10/16* (2006.01)

(52) U.S. Cl. ..... 175/331; 175/341

(58) Field of Classification Search ..... 175/331, 175/341

See application file for complete search history.

(56) References Cited

U.S. PATENT DOCUMENTS

| | | | | |
|---|---|---|---|---|
| 6,241,034 | B1 * | 6/2001 | Steinke et al. | 175/331 |
| 6,422,327 | B1 * | 7/2002 | Portwood et al. | 175/341 |
| 6,848,521 | B2 | 2/2005 | Lockstedt et al. | |
| 6,988,569 | B2 | 1/2006 | Lockstedt et al. | |
| 7,040,424 | B2 | 5/2006 | Yong et al. | |
| 7,367,413 | B2 | 5/2008 | Lockstedt et al. | |
| 7,377,332 | B2 | 5/2008 | Singh et al. | |
| 2008/0060852 | A1 * | 3/2008 | Chandila et al. | 175/374 |
| 2009/0188724 | A1 * | 7/2009 | Portwood et al. | 175/341 |

* cited by examiner

*Primary Examiner*—William P Neuder
(74) *Attorney, Agent, or Firm*—Bracewell & Giuliani LLP

(57) ABSTRACT

An earth boring drill bit comprising cones, each cone having a land on its mid portion with at least two rows of compacts that are staggered with respect to adjacent compacts on another row. The compacts of these two rows may also have the same size. The compacts of these two inner rows are closer to each other than to any other compacts on the cone.

20 Claims, 6 Drawing Sheets

STAGGERED COMPACT ROW ON SAME LAND

BACKGROUND

1. Field of Invention

The disclosure herein relates in general to rolling cone earth boring bits, and in particular to a compact row arrangement on a rolling cone.

2. Description of Prior Art

Drilling systems having earth boring drill bits are used in the oil and gas industry for creating wells drilled into hydrocarbon bearing substrata. Drilling systems typically comprise a drilling rig (not shown) used in conjunction with a rotating drill string wherein the drill bit is disposed on the terminal end of the drill string and used for boring through the subterranean formation.

Drill bits typically are chosen from one of two types, either drag bits or roller cone bits. Rotating the bit body with the cutting elements on the outer surface of the roller cone body crushes the rock and the cuttings may be washed away with drilling fluid. A rolling cone earth boring bit has a bit body with typically three legs. A bearing pin depends from each leg and a cone mounts rotatably to each bearing pin. The cones have rows of cutting teeth on the outer surface of the cone. In one type, the cutting elements comprise teeth machined into the surface of the cone. In another type, the cutting elements comprise carbide compacts or inserts that are pressed-fitted into mating holes in the cone surface.

Compacts generally have a cylindrical base that is inserted into a hole and a protruding cutting tip. The cutting tips may have chisel, hemispherical, ovoid or other shapes. Particularly on the heel row, which is located near the gage surface of each cone, the compacts may have asymmetrical shoulder surfaces for engaging the sidewall of the bore hole. Depending upon the formation being drilled, different shapes are utilized for aggressiveness of cutting and durability.

One example of a roller cone bit 11 is provided in side view in FIG. 1, the bit 11 having a body 13 with legs 15, roller cone bits typically comprise three legs 15. A cone 17 rotatably mounts to a bearing pin (not shown) on each leg 15. Each cone 17 has a plurality of inserts 19, arranged in at least one inner row. A plurality of outer or heel row compacts 21 are adjacent to a gage surface 23 of each cone 17. In the embodiment shown, heel row compacts 21 are generally ovoid, although different shapes could be used.

An example of a roller cone 17 is provided in side view in FIG. 2. The roller cone 17 is shown as a conical structure generally symmetric about an axis $A_X$, and having a base 18 on a lower end and an upper 43 on the opposite end. The cone 17 radius linearly decreases from the base 18 to the upper 43. The inserts 19 or compacts are disposed on portions of the cone 17 outer surface referred to as lands. The lands include an outer land 27, a first inner land 33, and a second inner land 37. The outer land 27 is defined by the cone 17 outer surface proximate to the roller cone base 18. The outer land 27 is bounded on a lower side by the roller cone base 18 and its upper side by a curved surface 28. The curved surface 28 comprises a radial indentation or groove circumscribing the cone 17 outer surface. The second inner land 37 is defined by the cone 17 outer surface proximate to the upper 43. A second curved surface 34 is disposed between the second inner land 37 and the first inner land 33.

Still referring to FIG. 2, the outer land 27 includes inserts 19 thereon arranged in a first row 29 and a second row 31. The rows 29, 31 extend along a generally circular path about the axis $A_X$. Being disposed above the first row 29, the second row 31 follows a circular path having a diameter less than or equal to the first row. The first and second inner lands 33, 37 have a single row 35, 39 of compacts 19 respectively formed thereon.

FIG. 3 schematically represents a borehole profile of a prior art roller cone bit. The profile depicts multiple compact outlines along an azimuthal line $L_{BH}$ radially extending outward from a bottomhole centerline. Each compact outline corresponds to an individual compact 19, or row 35, 39 of compacts 19, on a roller cone bit. The compact outlines represent where the compacts 19 strike the bottomhole at the azimuthal line $L_{BH}$ during a 360° drill bit rotation. Notations are associated with each compact outline identifying which of three cones the compact 19 is located and the total number of compacts in the row where the compact is attached. For example, the compact outline denoted by 14-1 represents a compact from a row having 14 compacts from cone 1 of a drill bit.

SUMMARY OF INVENTION

Disclosed herein is an earth boring drill bit having a roller cone with more than one row of compacts on an inner portion, such as a land, on the outer surface of the roller cone. In one embodiment, the earth boring bit comprises a body, a leg depending from the body, a roller cone rotatingly affixed to the leg, the roller cone having a heel area with a heel row of contacts, an upper area with at least one nose compact, a first inner row of compacts between the heel row compacts and the nose compact, and a second inner row of compacts between the first inner row of compacts and the nose compact, wherein the distance between the centerline of the first and second inner row of compacts is exceeded by the distance between the centerline of any other two rows of compacts on the roller cone.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 4:
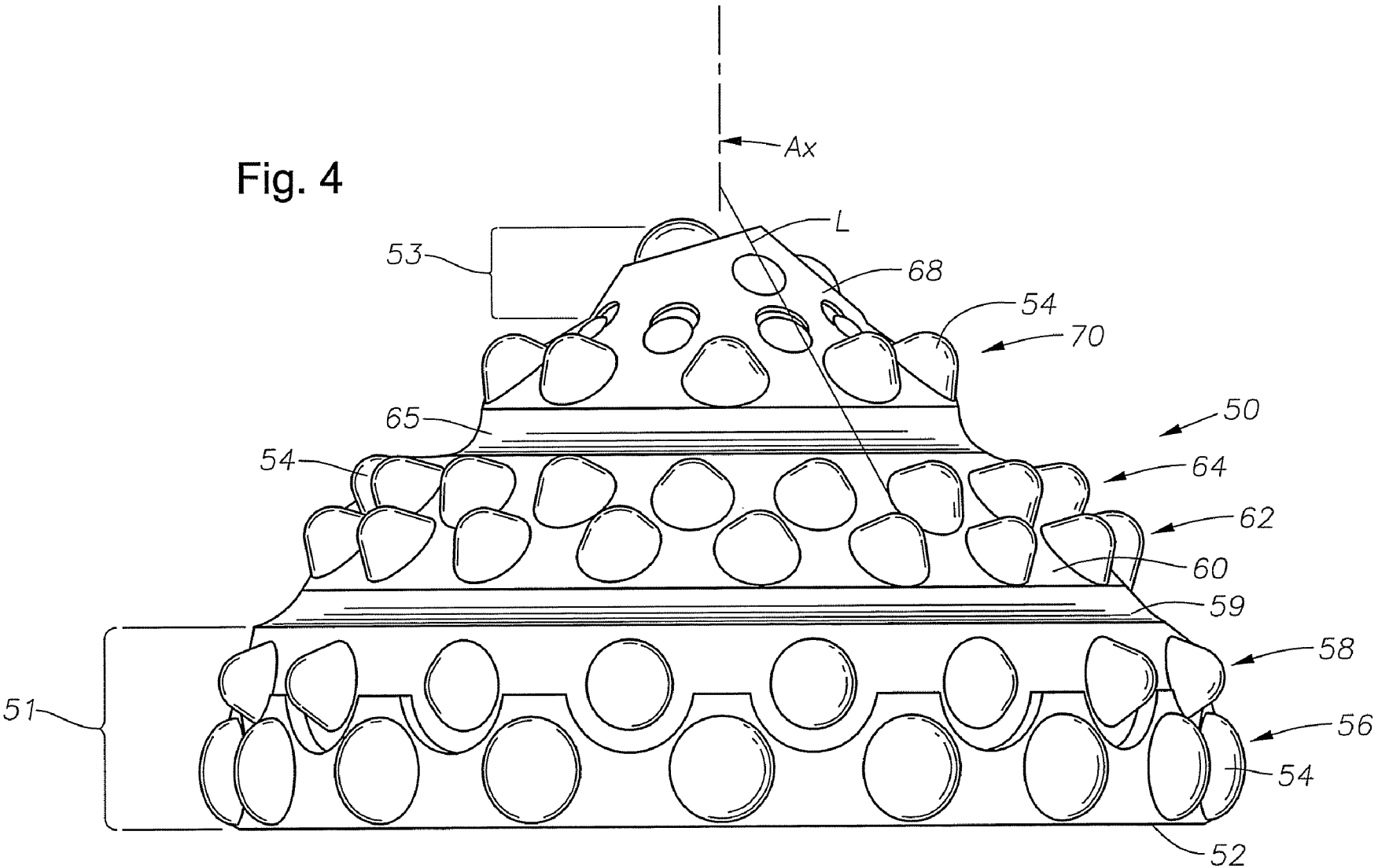
FIG. 4 illustrates a side view of a roller cone described herein.

With reference now to FIG. 4, an example of a roller cone 50 in accordance with the present disclosure is illustrated in a side view. The frusto-conical roller cone 50 includes a heel portion 51 disposed proximate to its base and an upper portion 53 at its apex opposite to the heel portion 51. An axis $A_X$ extends between the heel portion 51 and upper portion 53. The roller cone 50 includes multiple lands circumferentially surrounding the cone 50 outer surface. The lands include an outer land 52, an inner land 60, and an upper land 68. The lands 52, 60, 68 are generally frusto-conically shaped portions having an outer surface for affixing compacts to the roller cone 50. Each land 52, 60, 68 comprises a single continuous surface. The outer land 52 is depicted along the heel portion 51 as having compacts 54 affixed onto the roller cone 50 surface that are arranged in a first or outer row 56 and a second or adjacent row 58. The rows 56, 58 encircle the cone 50 each following a path that curves with the roller cone 50 surface. As shown, each path lies in a plane substantially perpendicular to the axis $A_X$. Optionally, the path may lie in a plane oblique to the axis $A_X$, yet further optionally, the rows 56, 58 may form a path that curves lateral to the axis $A_X$. In one embodiment, the compacts 54 in the first row 56 are substantially the same size as the compacts in the second row 58.

An annular curved indentation or groove 59 is formed in the roller cone 50 outer surface along the upper edge of the outer land 52. The curved indentation 59 has a semi-circular cross section that circumscribes the roller cone 50, the indentation 59 lies in a plane generally perpendicular to the axis $A_X$. The curved indentation 59 is bounded on its upper end by the inner land 60. The inner land 60 also includes compacts 54 formed thereon arranged in a first inner row 62 and a second inner row 64. The first and second inner rows (62, 64) each define a curved path as they circumscribe the outer periphery of the roller cone 50. The curved lines formed by the first and second inner rows 62, 64 each lie in a plane, wherein the planes are substantially parallel to one another. In the embodiment shown, the compacts 54 in the first and second inner rows 62, 64 are in a staggered arrangement. For the purposes of discussion herein, staggered means the compacts 54 in row 64 are offset from the compacts in row 62. More specifically, a line L connecting the center of a compact 54 in row 62 with the axis $A_X$ would not intersect the center of any compacts 54 in row 64. Staggering can also include an arrangement where the line L does not intersect any portion of a compact 54 in row 64. In the embodiment of FIG. 4, the rows 56, 58 on the outer land 52 are also depicted as being staggered.

The inner land 68 is formed on the roller cone 50 in the upper area 53. Another annular curved or grooved indentation 65 is provided on the roller cone 50 outer surface and disposed between the inner land 60 upper periphery and the upper land 68 lower edge. The compacts 54 in the upper area 53 are illustrated arranged in an upper row 70 circumscribing the roller cone 50 about the axis $A_X$.

Figure 1:
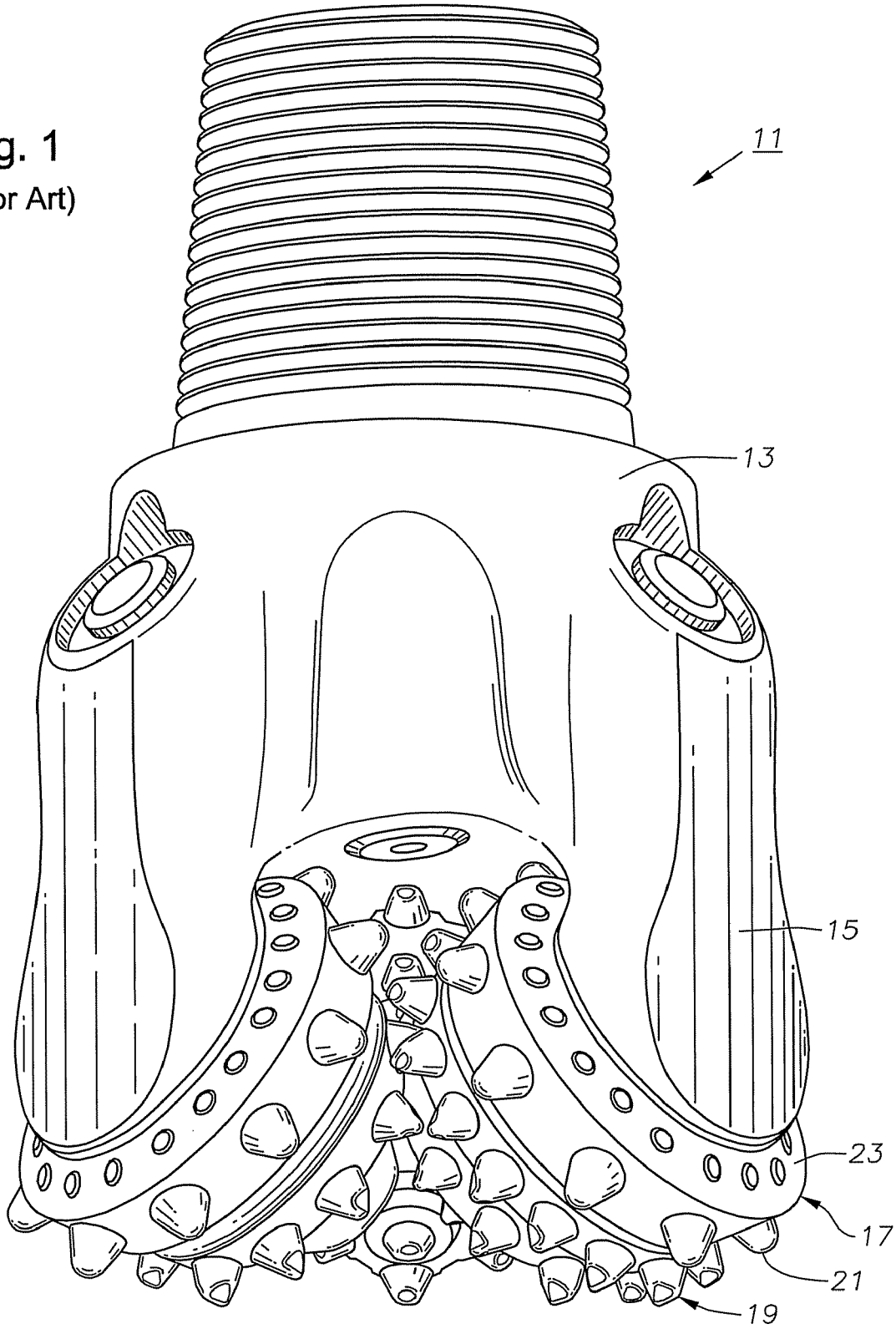
Fig. 1 (Prior Art)
FIG. 1 is a side perspective view of a prior art roller cone bit.
Figure 2:
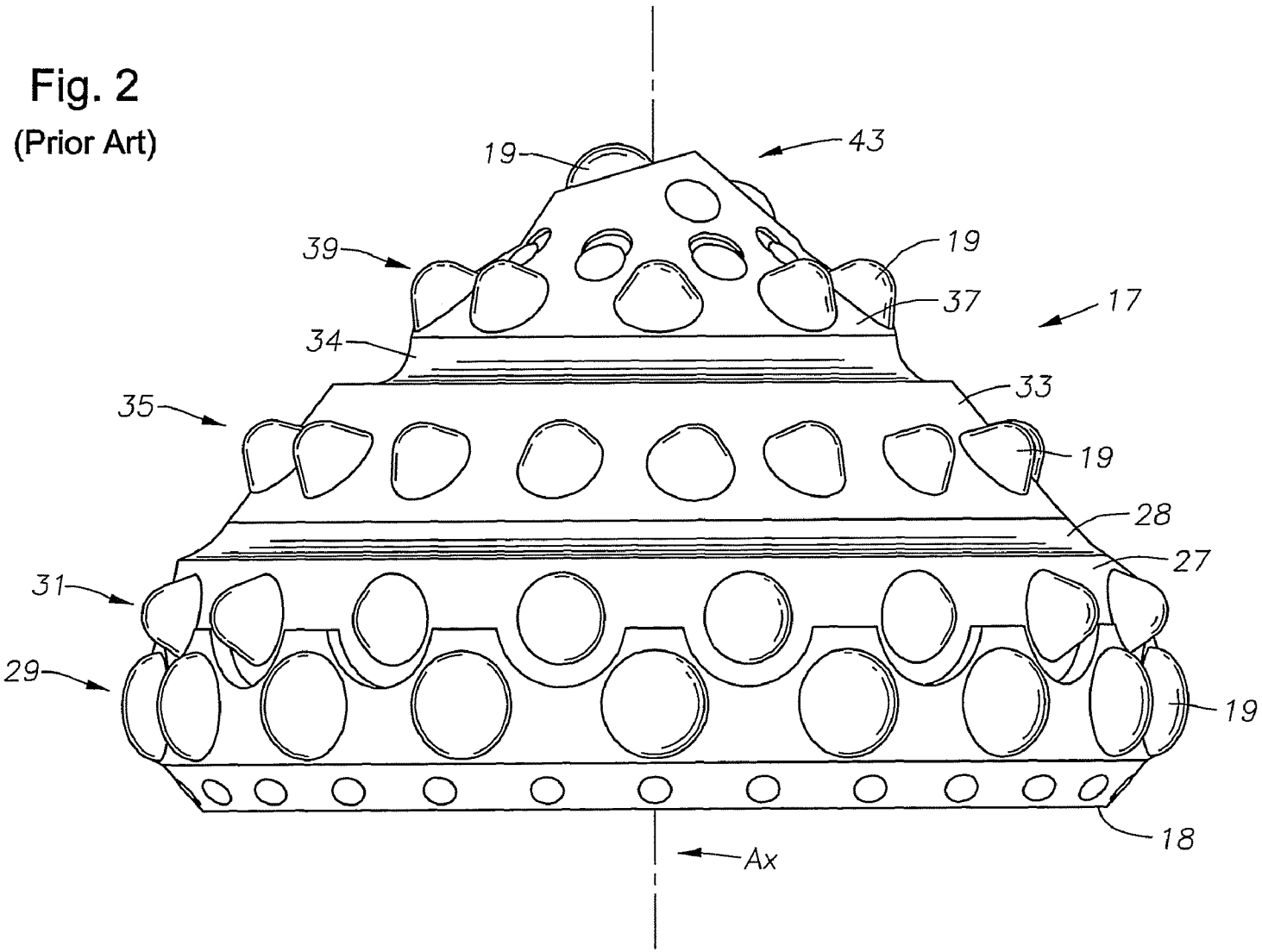
Fig. 2 (Prior Art)
FIG. 2 depicts a side view of a prior art roller cone.
Figure 3:
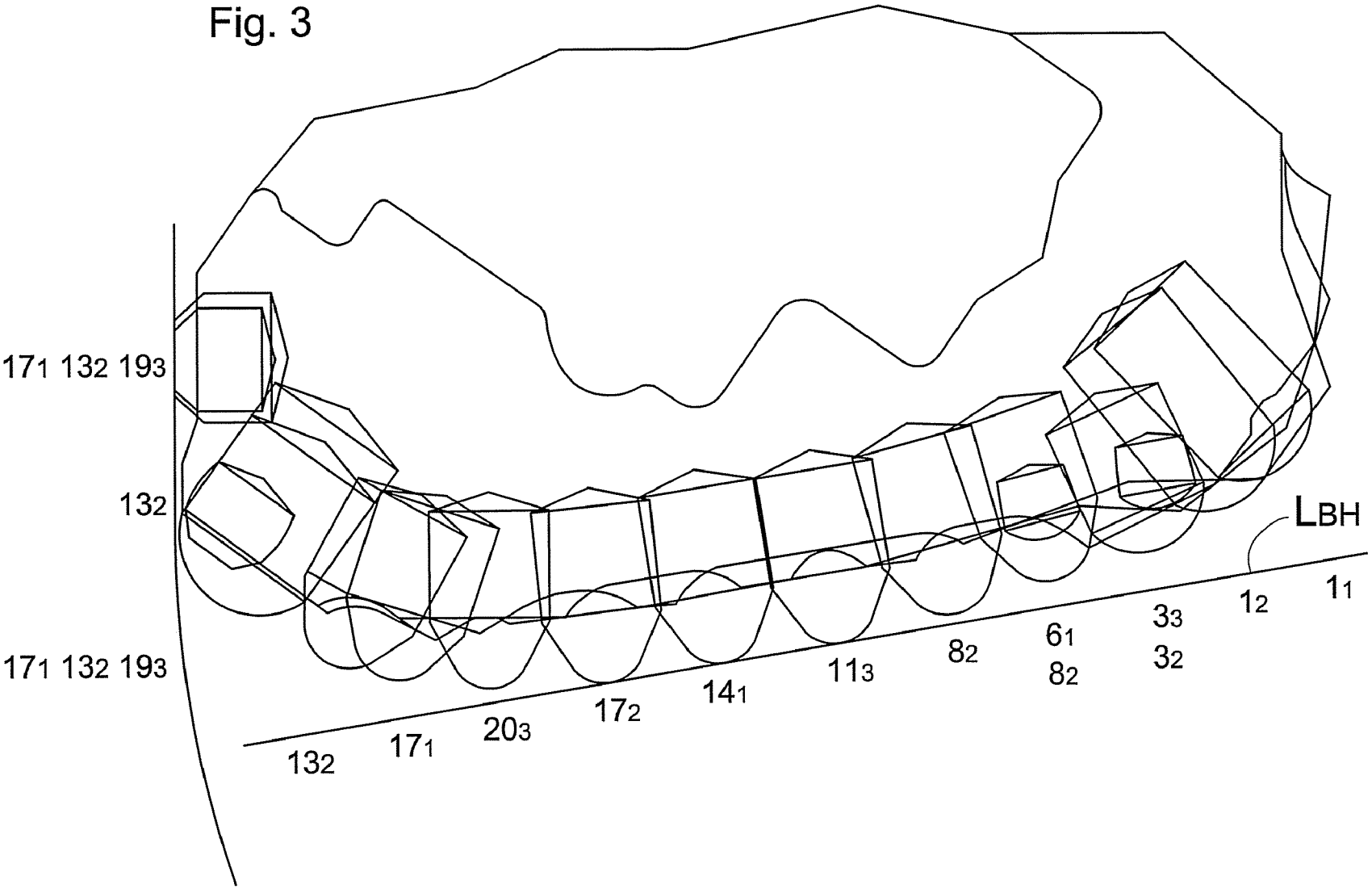
FIG. 3 is a schematic view of a compact profile along a bottomhole for a prior art roller cone bit.
Figure 5:
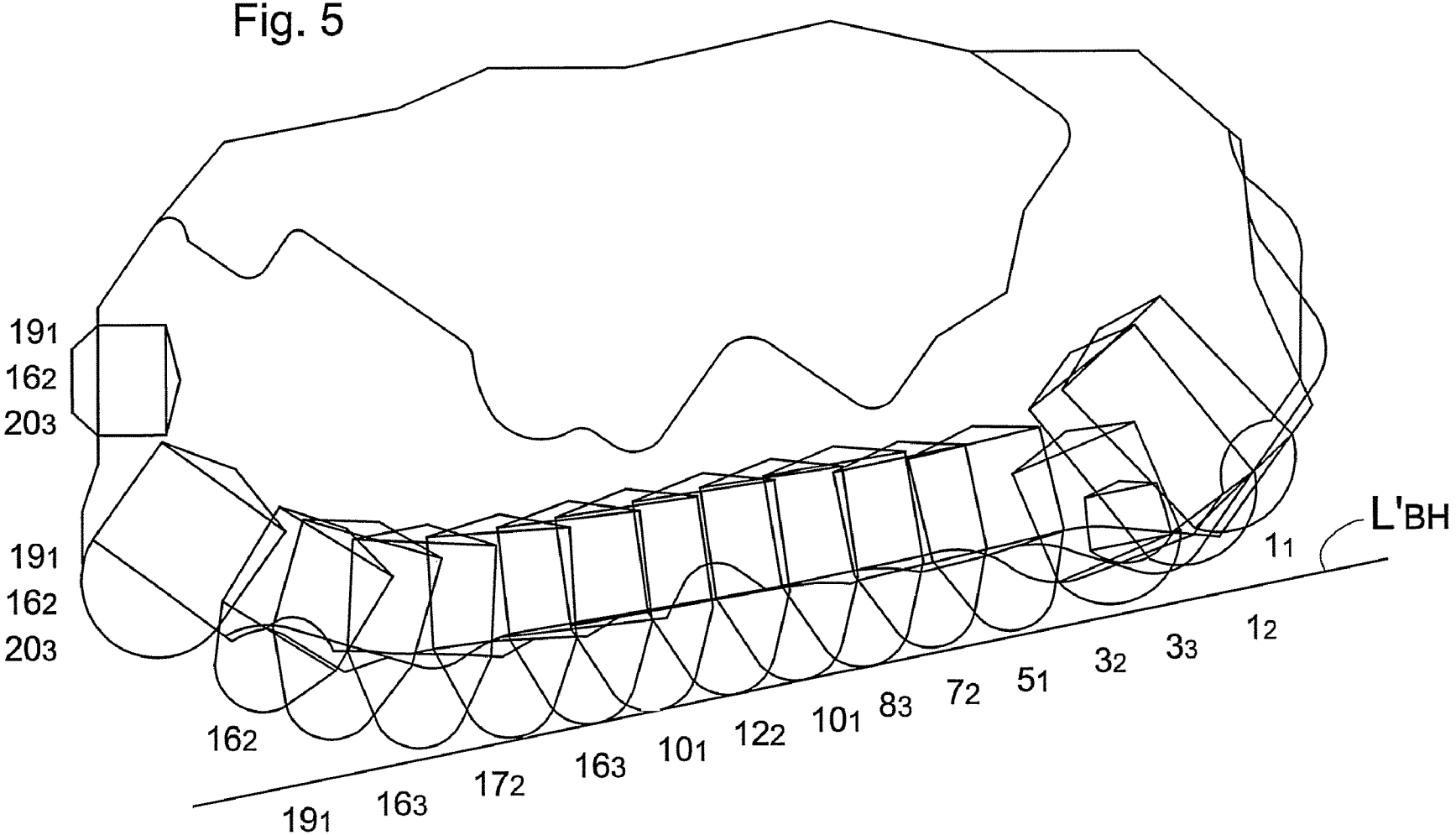
FIG. 5 is a compact bottomhole profile of the roller cone bit having a cone as in FIG. 4.

FIG. 5 is a profile schematically illustrating compact contact of a drill bit on a bottomhole. Similar to FIG. 3, the profile includes compact outlines representing compact locations as each compact strikes the bottomhole at a particular azimuth represented by line $L'_{BH}$. The outlines have associated notations indicating the number of compacts in that compact's row and the compact's roller cone. The outlines represent compact to bottomhole contact during one revolution of the drill bit. The bit represented by the profile in FIG. 5 includes two roller cones each having at least two rows of staggered teeth and illustrates one of the advantages of using such a bit. Comparing the FIG. 5 profile to the FIG. 3 profile, the FIG. 5 profile includes a higher density of compact interaction at the bottomhole. This is especially evident in the respective mid portions of the profiles that represent the inner land of the roller cone.

Referring now to the profile, compactor outlines denoted by 16-3 and 10-1 each appear twice. These outlines represent compacts within a first and second row on an inner land. Thus two compacts from rows having 16 compacts from the third cone contact the bottomhole at $L'_{BH}$, and two compacts from a row having 10 compacts from the first cone also contact the bottomhole at line $L'_{BH}$. In contrast, a drill bit profile having conventional roller cones would not include one of the 16-3 compacts and would also not include one of the 10-1 compacts; leaving open spaces in the profile thereby reducing the cutting density. Accordingly, affixing more than one row of compacts on an inner land increases compact to bottomhole interaction density thereby improving cutting efficiency and effectiveness.

Figure 6:
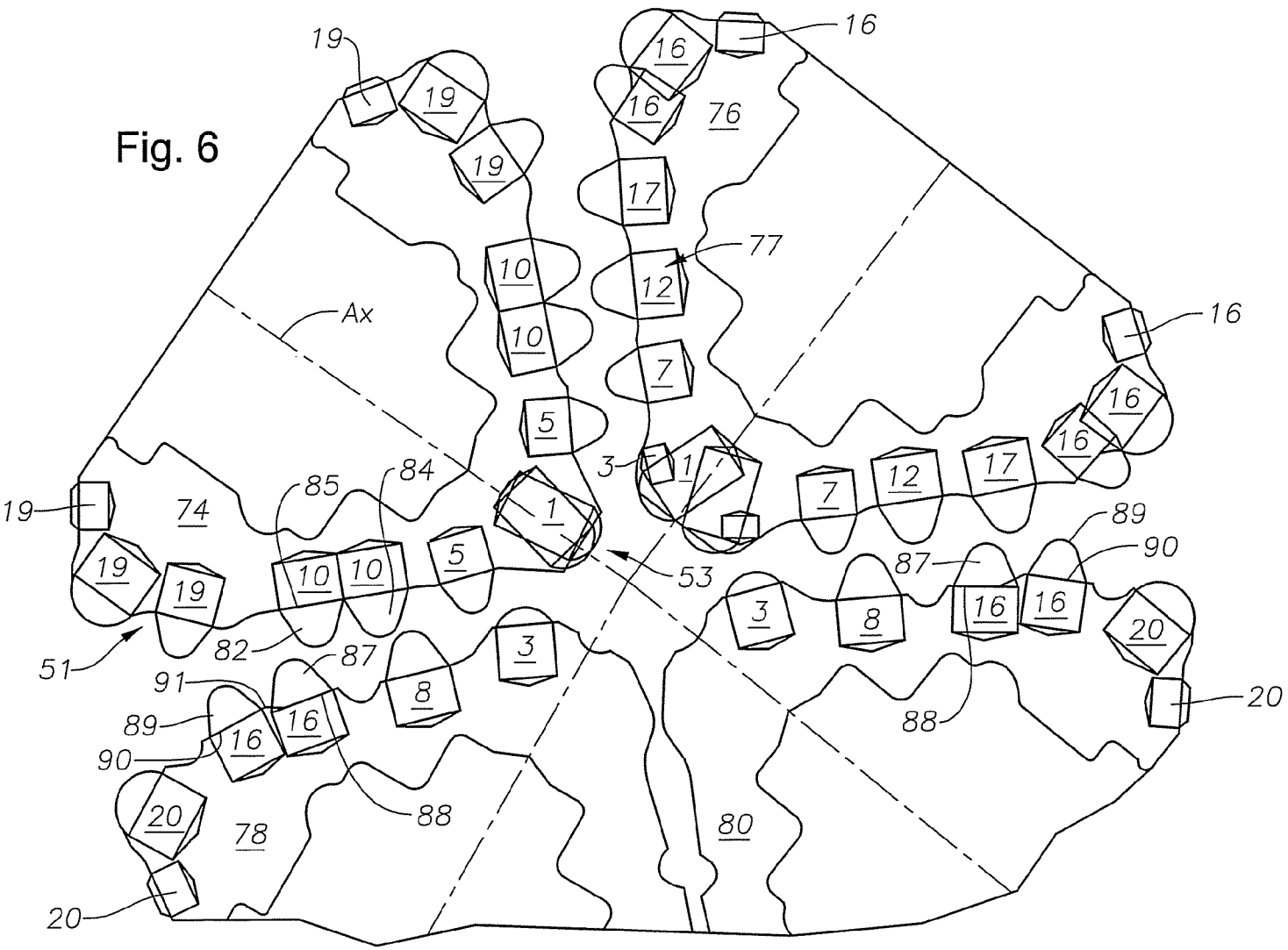
FIG. 6 is a layout view of the roller cone of FIG. 5 illustrating an example of its intermeshing with other roller cones on a drill bit.

FIG. 6 illustrates the drill bit used in forming the profile in FIG. 5 in an overhead view, where the drilling bit cones are depicted in a cross section and arranged to illustrate the intermeshing of compacts on different cones. More specifically, a first cone 74 schematic representation is shown having rows of compacts affixed to its outer surface. Compact row 82 and compact row 84 represent compact location along the cone surface between the heel portion 51 and the upper portion 53. Inner rows 82, 84 are located on the same land 85 and are staggered in the same manner as the inner rows 62, 64 of FIG. 4. However, the radial offset or staggered arrangement as discussed above is not evident from this view. Rotating the cone 74 about the axis $A_X$ each compact in the compact row 82 or compact row 84 would fall substantially within their respective compact outline.

Inner rows 87, 89 of compacts on the third cone 78, 80 are shown adjacent on the cone 78, 80. However the cone 78, 80 a transition 91 is between the compact row 87 and compact row 89. The surface is not continuous due to the transition 91, thus defining separate lands 88, 90 on which the compact rows 87, 89 are respectively located.

Each compact outline in FIG. 6 indicates the number of compacts within its row. For example, ten compacts are within the row represented by compact row 82 and compact outline row 84. As noted above, FIG. 6 reflects compact intermeshing between adjacent cones and thus does not reflect how the drill bit is assembled. The inner lands on the second cone 76 do not include more than one row of compacts, nor are these rows staggered. However the rows of compacts on the second cone 76 are arranged to intermesh with the compacts on the first 74 and third cones 78, 80. For example, the compact row 77 on the second cone 76 is aligned between the compacts in the first and second rows 82, 84.

It is to be understood that the invention is not limited to the exact details of construction, operation, exact materials, or embodiments shown and described, as modifications and equivalents will be apparent to one skilled in the art. For example, the scope of this disclosure includes roller cones having more than two inner rows of compacts on a roller cone land. Also included within the present scope are earth boring bits having roller cones, wherein staggered rows of compacts are provided on more than one cone of the bits. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

We claim:

1. An earth boring bit comprising:

a body;

a leg depending from the body;

a roller cone rotatingly affixed to the leg, the roller cone having a heel area with a heel row of compacts, an upper area with at least one nose compact;

a first inner row of compacts between the heel row compacts and the nose compact; and a second inner row of compacts between the first inner row of compacts and the nose compact, wherein the distance between the centerline of the first and second inner row of compacts is exceeded by the distance between the centerline of any other adjacent two rows of compacts on the roller cone.

2. The earth boring bit of claim 1, having a land circumscribing the roller cone outer surface a frusto-conical region with a continuous surface.

3. The earth boring bit of claim 1, wherein the compacts in the first inner row are substantially the same size as the compacts in the second inner row.

4. The earth boring bit of claim 2, wherein the land is an inner land that provides a surface for affixing the first and second inner row of compacts.

5. The earth boring bit of claim 1, wherein the first and second inner row compacts are located on adjacent conical lands.

6. The earth boring bit of claim I, wherein the compacts of the first inner row are staggered from the compacts of the second inner row such that each first inner row compact is located between and outward along the axis than two adjacent components of the second inner row.

7. The earth boring bit of claim 1, further comprising an adjacent row of compacts next and inward from the heel row compacts, the first inner row centerline being spaced axially from the centerline of the adjacent row greater than the distance to the second inner row.

8. The earth boring bit of claim 1, further comprising a third inner row of compacts between the second inner row and the nose compact, the third inner row centerline being spaced a greater distance from the nose compact than from the second inner row.

9. A roller cone bit comprising:

a bit body having a leg extending therefrom;

a roller cone rotatingly affixed to the leg, the roller cone having a heel area on an end of the cone, an upper area on an opposite end of the cone, a heel row of compacts disposed on the heel area and at least one compact on the upper area, and a roller cone axis extending between the heel and upper areas; and first and second inner rows between the first and second compacts on the heel area and at least one compact on the upper area, the first and second inner rows being staggered relative to one another such that each compact of the first inner row is located between and outward from two compacts of the second inner row and the distance between any other two adjacent rows of compacts is greater than the distance between the first and second inner row of compacts.

10. The earth boring bit of claim 9, wherein a centerline of the first and second inner rows are closer along the axis to each other than to any compacts on the heel and-upper rows.

11. The earth boring bit of claim 9, wherein the compacts on the first and second inner rows are substantially the same size.

12. The earth boring bit of claim 9, further comprising an annular space between the heel area and the first inner row and an annular space between the upper are and the second inner row, the first and second inner rows are free of any annular space therebetween.

13. The earth boring bit of claim 9, wherein the compacts in the first inner row are substantially the same size as the compacts in the second inner row.

14. The earth boring bit of claim 9, wherein the first and second inner row compacts are located on adjacent conical lands.

15. An earth boring bit comprising:

legs attached to a bit body;

a first roller cone, a second roller cone, and a third roller cone each rotatingly attached to a leg;

the first roller cone having a heel area with a heel row of contacts, an upper area with at least one nose compact;

a first inner row of compacts between the heel row compacts and the nose compact; and a second inner row of compacts between the first inner row of compacts and the nose compact, wherein the distance between the centerline of the first and second inner row of compacts is exceeded by the distance between the centerline of any other two rows of compacts on the roller cone, a roller cone axis extending between the heel and nose compact, wherein the first and second inner rows are staggered relative to one another such that each compact of the first inner row is located between and outward from two compacts of the second inner row and the distance between any other two adjacent rows of compacts is greater than the distance between the first and second inner row of compacts.

16. The earth boring bit of claim 15, wherein the second cone comprises an inner row of compacts having a centerline intermeshed between the first cone first and the second inner rows.

17. The earth boring bit of claim 15, further comprising first and second inner rows of compacts on the third cone, the first and second inner rows being staggered relative to one another such that each compact of the first inner row is located between and outward from two compacts of the second inner row and the first and second inner rows of the third cone being further from an axis of the bit than the first and second inner rows of the first cone.

18. The earth boring bit of claim 17, further comprising a heel row and an adjacent row on the first cone, the first inner row of the third cone inward on an axis from the adjacent row on the first cone.

19. The earth boring bit of claim 15, further comprising a single land on the first cone, the land providing a surface on which the first and second row of compacts are affixed.

20. The earth boring bit of claim 18, further comprising a first and second land on the third cone, the first and second lands coaxially circumscribing an axis of the third cone and disposed adjacent one another, wherein one of the first or second land provides a surface for affixing one of the first or second inner rows, and the other of the first or second land provides a surface for affixing the other of the first or second inner rows.

* * * * *

UNITED STATES PATENT AND TRADEMARK OFFICE

CERTIFICATE OF CORRECTION

PATENT NO. : 7,779,936 B2
APPLICATION NO. : 12/237602
DATED : August 24, 2010
INVENTOR(S) : Floyd C. Felderhoff et al.

It is certified that error appears in the above-identified patent and that said Letters Patent is hereby corrected as shown below:

Column 1, line 39, after "legs 15" delete "," and insert --,-- and delete "roller" and insert --Roller--
Column 3, line 23, after "50" insert a --,-- before "each"
Column 3, line 34, delete "," after "50" and insert a --.-- and delete "the" and insert --The--
Column 4, line 40, insert --has-- after "80"
Column 5, line 21, insert --comprising-- after "surface"
Column 5, line 64, delete "a centerline" and insert --centerlines--
Column 6, line 6, delete "are" and insert --row--
Column 6, line 7, delete "are" and insert --being--
Column 6, line 19, insert a --,-- after "cone"
Column 6, delete "contacts" and insert --compacts--
Column 6, line 46, insert a --,-- before "and the first"
Column 6, line 51, insert --being-- after "cone" and delete "on an" and insert --relative to the--

Signed and Sealed this

Twenty-third Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,779,936 B2
APPLICATION NO. : 12/237602
DATED : August 24, 2010
INVENTOR(S) : Floyd C. Felderhoff et al.

It is certified that error appears in the above-identified patent and that said Letters Patent is hereby corrected as shown below:

Column 1, line 39, after “legs 15” delete “,” and insert --.-- and delete “roller” and insert --Roller--
Column 3, line 23, after “50” insert a --,-- before “each”
Column 3, line 34, delete “,” after “50” and insert a --.-- and delete “the” and insert --The--
Column 4, line 40, insert --has-- after “80”
Column 5, line 21, insert --comprising-- after “surface”
Column 5, line 64, delete “a centerline” and insert --centerlines--
Column 6, line 6, delete “are” and insert --row--
Column 6, line 7, delete “are” and insert --being--
Column 6, line 19, insert a --,-- after “cone”
Column 6, line 21, delete “contacts” and insert --compacts--
Column 6, line 46, insert a --,-- before “and the first”
Column 6, line 51, insert --being-- after “cone” and delete “on an” and insert --relative to the--

This certificate supersedes the Certificate of Correction issued November 23, 2010.

Signed and Sealed this
Twenty-second Day of March, 2011

David J. Kappos

David J. Kappos
*Director of the United States Patent and Trademark Office*